United States Patent [19]

Mann

[11] Patent Number: 4,862,521

[45] Date of Patent: Sep. 5, 1989

[54] WATCH SUPPORTING, PROTECTING AND INSULATING DEVICE

[76] Inventor: Kevin D. Mann, 107 Hill Park Dr., Berkley, W. Va. 25801

[21] Appl. No.: 130,527

[22] Filed: Dec. 9, 1987

[51] Int. Cl.[4] ..... A41D 19/00

[52] U.S. Cl. ..... 2/160; 224/903

[58] Field of Search ..... 2/160; 224/152, 180, 224/903

[56] References Cited

U.S. PATENT DOCUMENTS

| | | | |
|---|---|---|---|
| 499,891 | 6/1893 | Schlesicky | 224/903 X |
| 601,982 | 4/1898 | Peirson | 2/160 X |
| 825,510 | 7/1906 | Bloc et al. | 2/160 |
| 1,309,150 | 7/1919 | Monfort | 2/160 X |
| 1,374,257 | 4/1921 | Van Raalte | 2/160 |
| 1,416,653 | 5/1922 | Lenneberg | 2/160 |
| 1,416,654 | 5/1922 | Lenneberg | 2/160 X |
| 1,524,137 | 1/1925 | Kastl et al. | 2/160 |
| 1,982,431 | 11/1934 | Hines | 2/160 |
| 2,103,711 | 12/1937 | Cole | 2/160 |
| 2,496,734 | 2/1950 | Macreadie | 2/160 |
| 2,547,991 | 4/1951 | Witbrod | 224/903 X |
| 4,083,321 | 4/1978 | Le Bron et al. | 2/DIG. 6 |
| 4,761,835 | 8/1988 | Chen | 2/160 |
| 4,766,611 | 8/1988 | Kim | 2/160 |

FOREIGN PATENT DOCUMENTS

| | | | |
|---|---|---|---|
| 0100936 | of 1916 | United Kingdom | 2/160 |

*Primary Examiner*—Werner H. Schroeder
*Assistant Examiner*—Sara M. Current
*Attorney, Agent, or Firm*—Richard C. Litman

[57] ABSTRACT

A watch supporting, protecting and insulating device, wherein, a glove has a pocket, which retains and protects a timepiece, permits viewing of the timepiece, and facilitates storage of other articles in the pocket.

3 Claims, 3 Drawing Sheets

WATCH SUPPORTING, PROTECTING AND INSULATING DEVICE

BACKGROUND OF INVENTION

1. Field of Invention

The invention relates to a combination glove and timepiece holder, and more particularly, the invention is directed to an improved device for supporting, protecting and insulating the timepiece, especially in cold weather.

The invention further relates to an improved glove construction which provides support, protection and insulation for a timepiece. The glove construction also provides for conveniently viewing the timepiece. The invention has a wide variety of applications, such as driving gloves, batting gloves, and work gloves. The invention further provides a convenient storage pocket for other small articles. Thus, the invention is particularly suited for use in cold or wet weather activities.

The invention can also be used for a variety of activities. The components and method of construction of the device are more fully described herein.

2. Description of the Prior Art

Various prior art watch supporting devices, and the like, as well as their apparatuses and the method of their construction in general, are known and found to be exemplary of the U.S. Prior Art. They are:

| U.S. Pat. Nos. | Inventor |
|---|---|
| 601,982 | Pierson |
| 1,416,653 | Lenneberg |
| 1,416,654 | Lenneberg |
| 2,103,711 | Cole |

U.S. Pat. No. 601,982 to Pierson discloses a watch case which supports a watch on the back of the wearer's hand.

U.S. Pat. No. 1,416,653 to Lenneberg discloses a glove attachment which supports a watch on a glove.

U.S. Pat. No. 1,416,654 to Lenneberg discloses a device which attaches a vanity case or coin holder to the back of a glove.

U.S. Pat. No. 2,103,711 to Cole discloses a timer's mitten which carries a stop watch in the palm of the mitten.

These patents or known prior art uses teach and disclose various types of watch supporting devices of sorts and of various manufactures, and the like, as well as methods of their construction; but none of them, whether taken singly or in combination, disclose the specific details of the combination of the invention in such a way as to bear upon the claims of the present invention.

SUMMARY OF THE INVENTION

An object, advantage and feature of the invention is to provide a novel watch support that is comfortable and efficient in use, and lends itself to outdoor activities.

Another object of the invention is directed further to a device providing easy viewing of the timepiece, thereby avoiding the need to adjust the wearer's sleeve in order to view the timepiece.

Still another object of the invention is to provide a novel and improved construction of a watch support which protects the watch from scratches, impacts, moisture and cold, thereby preserving the timepiece from damage and extending the life of the timepiece.

Yet another object of the invention is to provide a novel and improved construction of a watch support which allows easy changing or removal and replacement of the timepiece.

These, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE PREFERRED EMBODIMENT

Figure 1:
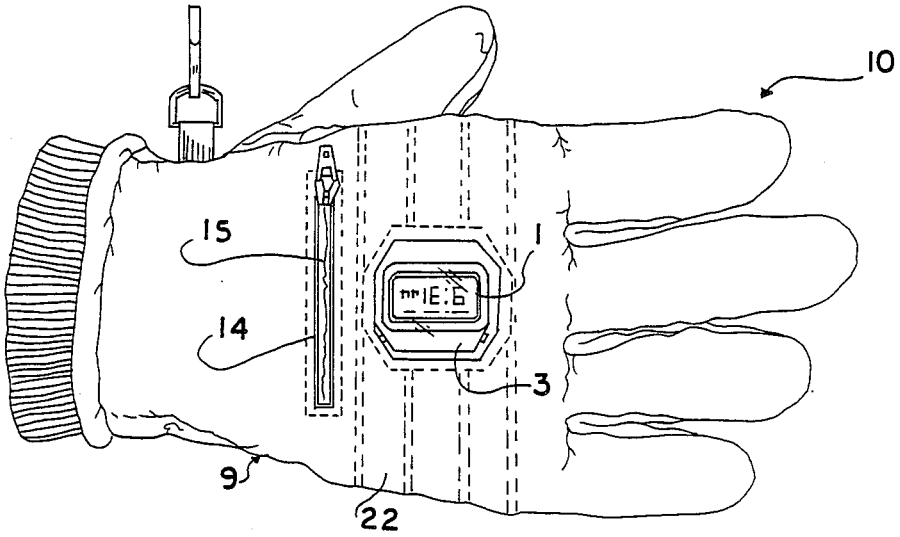
FIG. 1 is a top view of the invention illustrating a typical construction according to a preferred embodiment and best mode of the present invention.
Figure 2:
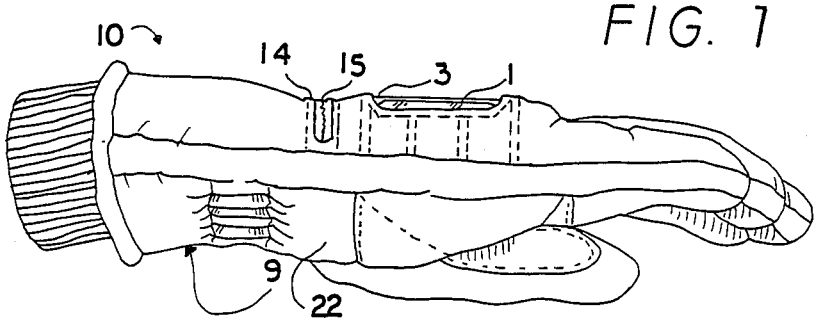
FIG. 2 is a side view of the invention according to a preferred embodiment and best mode of the present invention.
Figure 3:
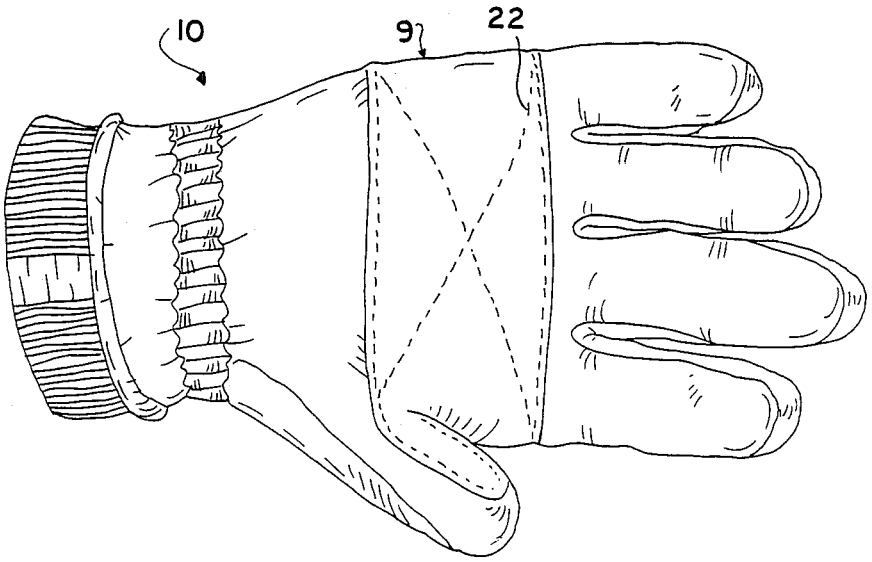
FIG. 3 is a bottom view of the invention according to a preferred embodiment and best mode of the invention.
Figure 4:
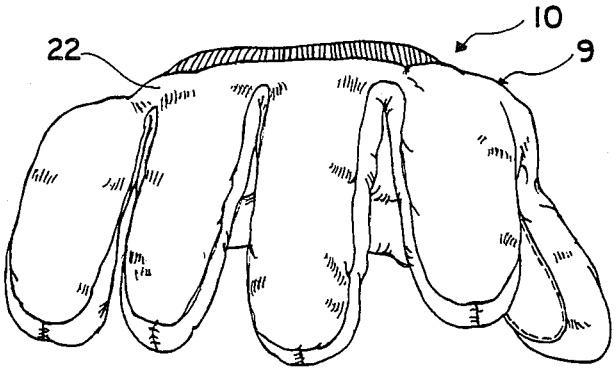
FIG. 4 is a front view of the invention according to a preferred embodiment and best mode of the invention.
Figure 5:
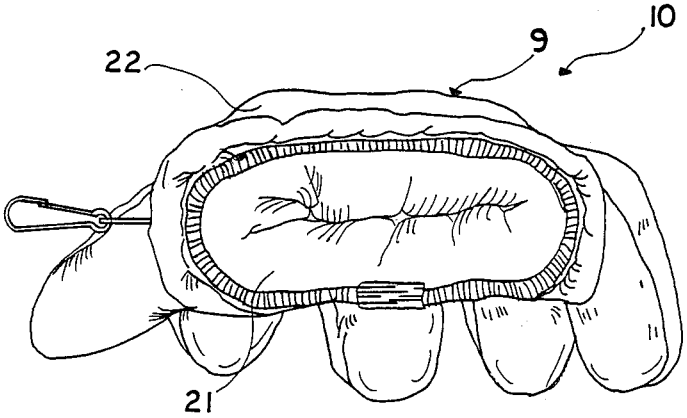
FIG. 5 is a rear view of the invention according to a preferred embodiment and the best mode of the invention.

Referring now to the drawings, there is shown in FIG. 1 a top view of a watch supporting, protecting and insulating device 10 comprising an insulated glove 9 which encloses a removable timepiece 1. The timepiece 1 is viewable during operation through viewing means 3, which may be provided by a piece of transparent plastic or other suitable material.

Figure 6:
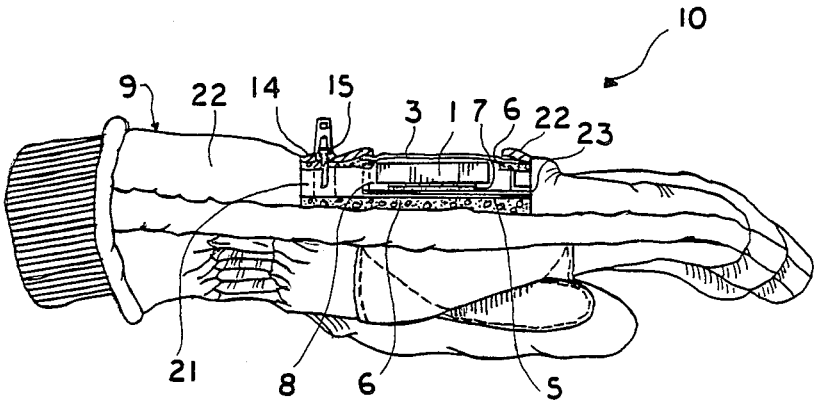
FIG. 6 is a side sectional view of the invention according to a preferred embodiment of the best mode of the invention.

As shown in FIG. 6, the timepiece 1 is retained inside a pocket 8 in the glove formed therein, by the outer covering 22 and the inner liner 21 of the glove. The pocket 8 may be divided by a middle liner 23, thereby forming a first watch supporting pocket 8 containing the timepiece 1 and a second pocket 5 for coins or other small articles.

The timepiece 1 is secured against movement by a securing means 7. The securing means 7 may be provided by a strip of hook and loop fastener attached to the back of the timepiece 1 and also attached to the middle liner 23, as shown in FIG. 6.

Figure 7:
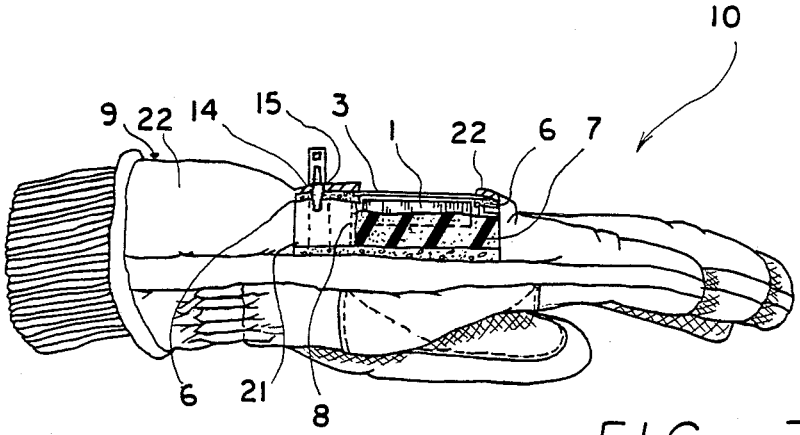
FIG. 7 is a side sectional view of an alternative embodiment of the invention.

Alternatively, as shown in FIG. 7, the securing means 7 may be provided by a block of foam having a depression which surrounds the sides of timepiece 1 and fits snugly within watch supporting pocket 8, thereby securing the timepiece against movement.

FIG. 7 also shows an embodiment of the invention where the invention features a single watch supporting pocket 8.

The outer covering 22 of the glove 9 contains a slot 15 which provides an opening into the watch supporting pocket 8. The slot 15 features slot closure means 14, such as a zipper or other releasable fastener. The slot closure means 14 will protect the timepiece 1 and other contents of second pocket 5 from dirt and moisture.

The inner liner 21 and outer covering 22 may feature insulation 6 as shown. The glove insulation 6 provides not only temperature insulation of the timepiece 1, but also provides cushioning of the timepiece 1 from impacts. Both the cushioning and insulation properties of the insulation layers 6 can extend the useful life of the timepiece 1, by protecting the timepiece 1 from cold, impact, abrasion and other environmental hazards.

In order to more fully insulate and protect the watch from damage or moisture, the outer covering 22 of the glove may be constructed of breathable nylon fabric or other suitable waterproof material. The waterproofing of the outer covering 22 and slot closure means 14 may extend the useful life of the timepiece 1 by protecting it from moisture. This feature can allow a timepiece which would otherwise be unsuited for wet environments to be used in such environments.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A combination glove and timepiece holder, comprising:

an inner liner in the back of said glove;

an outer covering over the back of said glove;

said inner liner and said outer covering defining a compartment in the back of said glove;

said timepiece removably disposed in said compartment;

said outer covering having a slot therein for insertion and removal of the timepiece;

means for closing said slot;

means for viewing said timepiece, said viewing means including an aperture in said outer covering, said aperture covered by a sheet of translucent or transparent material;

means for securing said timepiece within said compartment, including resilient, compressible block shaped to fit snugly inside said compartment, said resilient, compressible block having a top surface and a lower surface, said resilient compressible block having a depression extending downwardly into said top surface, said depression shaped to conform to the side and lower edges of said timepiece, said resilient compressible block thereby securing said timepiece against movement inside said compartment; and said resilient, compressible block has an uncompressed thickness greater than the internal height of said compartment, so that when said timepiece is set into said depression and inserted into said compartment, said resilient compressible block is compressed and exerts a continuous force against said timepiece and against said compartment, thereby securing said timepiece against motion within said compartment.

2. A combination glove and timepiece holder, comprising:

an inner liner in the back of said glove;

an outer covering over the back of said glove;

said inner liner and said outer covering defining a compartment in the back of said glove;

a middle liner divides said compartment into a first compartment for holding said timepiece and a second compartment for storage of other articles;

said timepiece removably disposed in said compartment;

said outer covering having a slot therein for insertion and removal of the timepiece;

means for closing said slot;

means for viewing said timepiece, said viewing means including an aperture in said outer covering, said aperture covered by a sheet of translucent or transparent material; and means for securing said timepiece within said compartment, including resilient, compressible block shaped to fit snugly inside said compartment, said resilient, compressible block having a top surface and a lower surface, said resilient compressible block having a depression extending downwardly into said top surface, said depression shaped to conform to the side and lower edges of said timepiece, said resilient compressible block thereby securing said timepiece against movement inside said compartment.

3. A combination glove and timepiece holder, comprising:

an inner liner in the back of said glove;

an outer covering over the back of said glove;

said inner liner and said outer covering defining a compartment in the back of said glove;

said timepiece removably disposed in said compartment;

said outer covering having a slot therein for insertion and removal of the timepiece;

means for closing said slot;

means for viewing said timepiece, said viewing means including an aperture in said outer covering, said aperture covered by a sheet of translucent or transparent material;

means for securing said timepiece within said compartment, including resilient, compressible block shaped to fit snugly inside said compartment, said resilient, compressible block having a top surface and a lower surface, said resilient compressible block having a depression extending downwardly into said top surface, said depression shaped to conform to the side and lower edges of said timepiece, said resilient compressible block therapy securing said timepiece against movement inside said comprising; and said outer covering includes a waterproof outer layer and an inner insulation layer;

said transparent or translucent material being waterproof;

said means for closing said slot being waterproof;

whereby said timepiece is protected from water and extreme temperatures in the environment.

* * * * *